US008602241B1

(12) United States Patent
Kuo et al.

(10) Patent No.: US 8,602,241 B1
(45) Date of Patent: Dec. 10, 2013

(54) MULTI-SIZE UNIVERSAL JOINTED PACKAGE BOX

(71) Applicant: Shenzhen China Star Optoelectronics Technology Co., Ltd., Guangdong (CN)

(72) Inventors: Yicheng Kuo, Shenzhen (CN); Shihhsiang Chen, Shenzhen (CN); Jiaxin Li, Shenzhen (CN); Jiahe Cheng, Shenzhen (CN)

(73) Assignee: Shenzhen China Star Optoelectronics Technology co., Ltd., Shenzhen, Guangdong (CN)

( * ) Notice: Subject to any disclaimer, the term of this patent is extended or adjusted under 35 U.S.C. 154(b) by 0 days.

(21) Appl. No.: 13/806,823

(22) PCT Filed: Nov. 28, 2012

(86) PCT No.: PCT/CN2012/085381

§ 371 (c)(1),
(2), (4) Date: Dec. 24, 2012

(30) Foreign Application Priority Data

Nov. 16, 2012 (CN) ..... 2012 1 0465160

(51) Int. Cl.
*B65D 19/02* (2006.01)

(52) U.S. Cl.
USPC ..... 220/4.28

(58) Field of Classification Search
USPC ..... 220/4.28, 4.32, 4.33, 4.34; 206/591, 206/592, 593, 594
See application file for complete search history.

(56) References Cited

U.S. PATENT DOCUMENTS

| | | | | | |
|---|---|---|---|---|---|
| 2,828,007 | A * | 3/1958 | Foss | 206/597 |
| 2,961,141 | A * | 11/1960 | Lukes | 206/303 |
| 4,050,604 | A * | 9/1977 | Flanders | 220/4.28 |
| 4,320,839 | A * | 3/1982 | Skaggs | 206/591 |
| 5,096,112 | A * | 3/1992 | Grigsby | 206/599 |
| 5,131,543 | A * | 7/1992 | Stephens | 206/523 |
| 5,184,727 | A * | 2/1993 | Dickie et al. | 206/522 |
| 5,642,830 | A * | 7/1997 | Foster | 220/4.28 |
| 5,722,551 | A * | 3/1998 | Cocciemiglio, Jr. | 220/4.33 |
| 5,958,212 | A * | 9/1999 | Yamamura et al. | 205/723 |
| 5,996,828 | A * | 12/1999 | Cheyn | 220/4.33 |
| 7,757,861 | B2 * | 7/2010 | Wang et al. | 206/591 |
| 2011/0114513 | A1 * | 5/2011 | Miller | 206/204 |

* cited by examiner

*Primary Examiner* — Steven A. Reynolds
*Assistant Examiner* — King M Chu
(74) *Attorney, Agent, or Firm* — Andrew C. Cheng

(57) ABSTRACT

The present invention provides a multi-size universal jointed package box, which includes a box body and waterproof pads arranged inside the box body. The box body includes first and second walls that are opposite to each other, third and fourth walls that are opposite to each other, four corner pieces connecting between the first, second, third, and fourth walls, and a cruciform support bracket connected to a middle portion of each of the first, second, third, and fourth walls, whereby couplings between the first, second, third, and fourth walls and the corner pieces and couplings between the first, second, third, fourth walls and the support bracket are all releasable couplings. The multi-size universal jointed package box uses a support bracket having four ends each forming resilient coupling keys and first, second, third, and fourth walls each forming a coupling slot to realize free style jointing for forming a package box.

9 Claims, 7 Drawing Sheets

MULTI-SIZE UNIVERSAL JOINTED PACKAGE BOX

BACKGROUND OF THE INVENTION

1. Field of the Invention

The present invention relates to the field of packaging, and in particular to a multi-size universal jointed package box.

2. The Related Arts

Liquid crystal display (LCD) has a variety of advantages, such as thin device body, low power consumption, and being free of radiation, and is thus widely used.

Referring to FIG. 1, a liquid crystal display device generally comprises a backlight module 100, a mold frame 300 arranged on the backlight module, a liquid crystal display panel 500 arranged on the mold frame 300, and a front bezel 700 arranged on the liquid crystal display panel 500. The backlight module 100 provides a planar light source of homogeneous illumination to the liquid crystal display panel 500. The mold frame 300 functions to carry the liquid crystal display panel 500. The front bezel 700 retains the liquid crystal display panel 500 on the mold frame 300.

The liquid crystal display panel often uses a blow-molded box as a package box when conveyed to module processing. Referring to FIG. 2, a schematic view is given to show the structure of a conventional package box, which comprises two opposite first walls 902, two opposite second walls 904, four corner pieces 906 connecting the first and second walls 902, 904, and a cruciform support bracket 908 connecting a middle portion of each of the first and second walls 902, 904. The first walls 902, the second walls 904, the corner pieces 906, and the support bracket 908 are each integrally formed of a blow-moldable material and thus have a relatively large weight. Further, each specific package box has a fixed internal receiving space, making it only fit to packaging liquid crystal display panels of a fixed size, so that the cost is high.

SUMMARY OF THE INVENTION

An object of the present invention is to provide a multi-size universal jointed package box, which has a simple structure, is easy to assemble and disassemble, has some parts that are commonly usable, and thus lowers down the manufacturing cost.

To achieve the object, the present invention provides a multi-size universal jointed package box, which comprises a box body and waterproof pads arranged inside the box body. The box body comprises first and second walls that are opposite to each other, third and fourth walls that are opposite to each other, four corner pieces connecting between the first, second, third, and fourth walls, and a cruciform support bracket connected to a middle portion of each of the first, second, third, and fourth walls, whereby couplings between the first, second, third, and fourth walls and the corner pieces and couplings between the first, second, third, fourth walls and the support bracket are all releasable couplings.

The support bracket comprises a cruciform main body and first, second, third, and fourth coupling members formed at four ends of the main body. The first and third coupling members are arranged opposite to each other. The second and fourth coupling members are arranged opposite to each other. The first, second, third, and fourth walls form first, second, third, and fourth coupling slots respectively corresponding to the first, second, third, and fourth coupling members. The first, second, third, and fourth coupling members are respectively received in and coupled to the first, second, third, and fourth coupling slots to couple the support bracket to the first, second, third, and fourth walls in a releasable manner.

The first, second, third, and fourth coupling members respectively comprise a plurality of resilient coupling keys formed at the four ends of the main body of the support bracket.

The first, second, third, and fourth coupling members and the main body are integrally formed together.

The first, second, third, and fourth coupling members are all of a linear form. The first coupling member has an end forming a first coupling section corresponding to the first coupling slot and an opposite end forming a second coupling section corresponding to the main body of the support bracket. The second coupling member has an end forming a third coupling section corresponding to the second coupling slot and an opposite end forming a fourth coupling section corresponding to the main body of the support bracket. The third coupling member has an end forming a fifth coupling section corresponding to the third coupling slot and an opposite end forming a sixth coupling section corresponding to the main body of the support bracket. The fourth coupling member has an end forming a seventh coupling section corresponding to the fourth coupling slot and an opposite end forming an eighth coupling section corresponding to the main body of the support bracket.

The main body of the support bracket forms fifth, sixth, seventh, and eighth coupling slots respectively corresponding to the second, fourth, sixth, and eighth coupling sections, whereby the second, fourth, sixth, and eighth coupling sections are respectively received in and coupled to the fifth, sixth, seventh, and eighth coupling slots to couple the first, second, third, and fourth coupling members to the main body of the support bracket in a releasable manner.

The first and third coupling members are of same structure and size and the second and fourth coupling members are of same structure and size.

The first and second walls each have two ends respectively forming first and second mounting sections. The corner pieces form first and second mounting slots corresponding to the first and second mounting sections. The third and fourth walls each have two ends respectively forming third and fourth mounting sections. The corner pieces form third and fourth mounting slots corresponding to the third and fourth mounting sections. The first, second, third, and fourth mounting sections are respectively received in and coupled to the first, second, third, and fourth mounting slots to couple the first, second, third, and fourth walls to the corner pieces in a releasable manner.

The first and second walls are of the same structure and size and the third and fourth walls are of the same structure and size.

The first, second, third, and fourth mounting sections are of the same structure and size and the first, second, third, and fourth the mounting slots are of the same structure and size.

The present invention also provides a multi-size universal jointed package box, which comprising a box body and waterproof pads arranged inside the box body, the box body comprising first and second walls that are opposite to each other, third and fourth walls that are opposite to each other, four corner pieces connecting between the first, second, third, and fourth walls, and a cruciform support bracket connected to a middle portion of each of the first, second, third, and fourth walls, whereby couplings between the first, second, third, and fourth walls and the corner pieces and couplings between the first, second, third, fourth walls and the support bracket are all releasable couplings;

wherein the support bracket comprises a cruciform main body and first, second, third, and fourth coupling members formed at four ends of the main body, the first and third coupling members being arranged opposite to each other, the second and fourth coupling members being arranged opposite to each other, the first, second, third, and fourth walls forming first, second, third, and fourth coupling slots respectively corresponding to the first, second, third, and fourth coupling members, the first, second, third, and fourth coupling members being respectively received in and coupled to the first, second, third, and fourth coupling slots to couple the support bracket to the first, second, third, and fourth walls in a releasable manner;

wherein the first, second, third, and fourth coupling members respectively comprise a plurality of resilient coupling keys formed at the four ends of the main body of the support bracket;

wherein the first, second, third, and fourth coupling members and the main body are integrally formed together;

wherein the first and second walls each have two ends respectively forming first and second mounting sections, the corner pieces forming first and second mounting slots corresponding to the first and second mounting sections, the third and fourth walls each having two ends respectively forming third and fourth mounting sections, the corner pieces forming third and fourth mounting slots corresponding to the third and fourth mounting sections, the first, second, third, and fourth mounting sections being respectively received in and coupled to the first, second, third, and fourth mounting slots to couple the first, second, third, and fourth walls to the corner pieces in a releasable manner;

wherein the first and second walls are of the same structure and size and the third and fourth walls are of the same structure and size; and wherein the first, second, third, and fourth mounting sections are of the same structure and size and the first, second, third, and fourth the mounting slots are of the same structure and size.

The efficacy of the present invention is that the present invention provides a multi-size universal jointed package box, which comprises a support bracket having four ends each forming resilient coupling keys and first, second, third, and fourth walls each forming a coupling slot to realize free style jointing for forming a package box, whereby the package box has a size that is adjustable to be fit to the transportation of liquid crystal display panels of various sizes. Further, the support bracket and corner pieces are commonly usable to thereby effectively lower down the manufacturing cost.

For better understanding of the features and technical contents of the present invention, reference will be made to the following detailed description of the present invention and the attached drawings. However, the drawings are provided for the purposes of reference and illustration and are not intended to impose undue limitations to the present invention.

BRIEF DESCRIPTION OF THE DRAWINGS

The technical solution, as well as beneficial advantages, of the present invention will be apparent from the following detailed description of an embodiment of the present invention, with reference to the attached drawings. In the drawings.

DETAILED DESCRIPTION OF THE PREFERRED EMBODIMENTS

Figure 1:
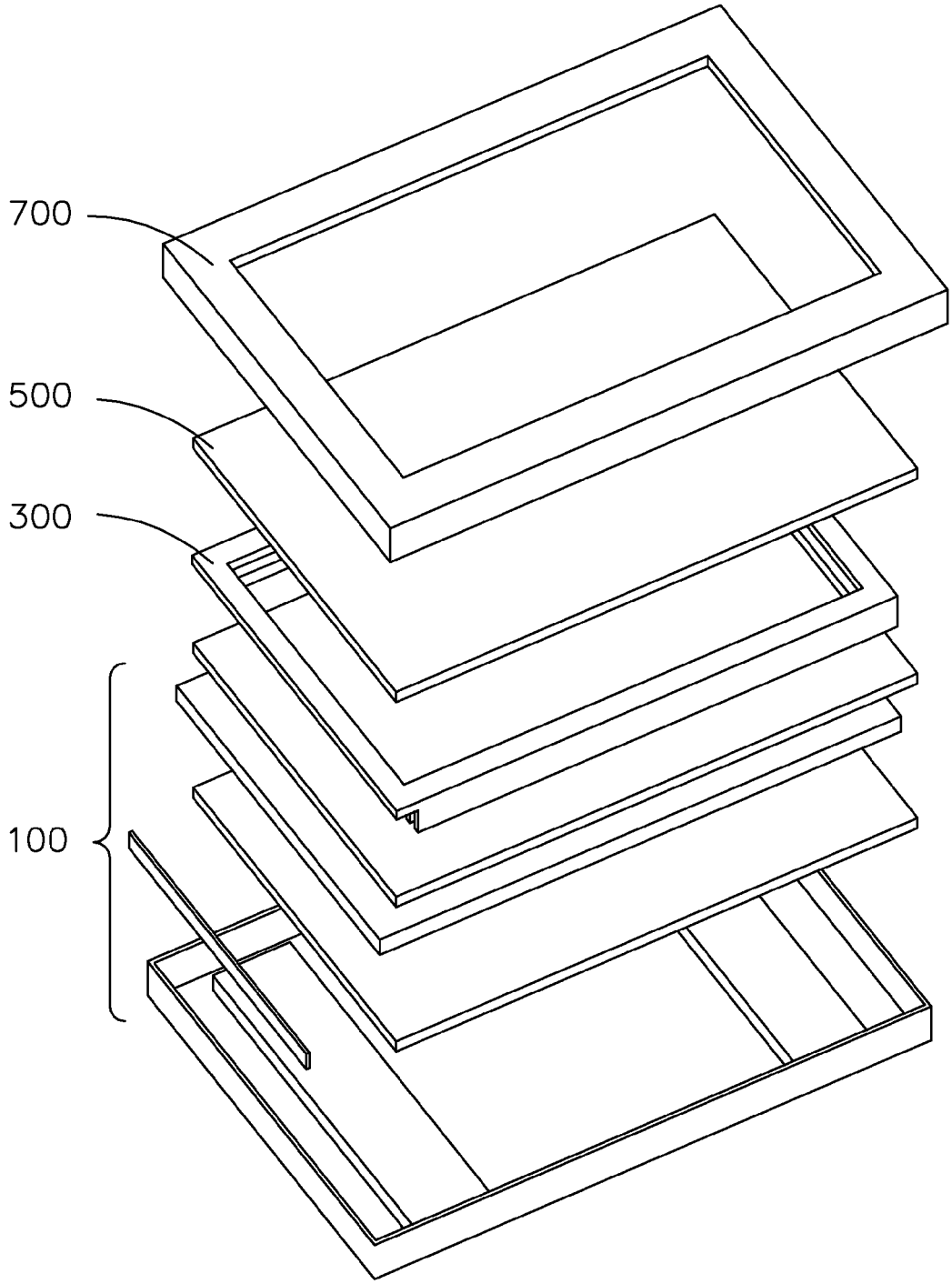
FIG. 1 is an exploded view showing a conventional liquid crystal display device.
Figure 2:
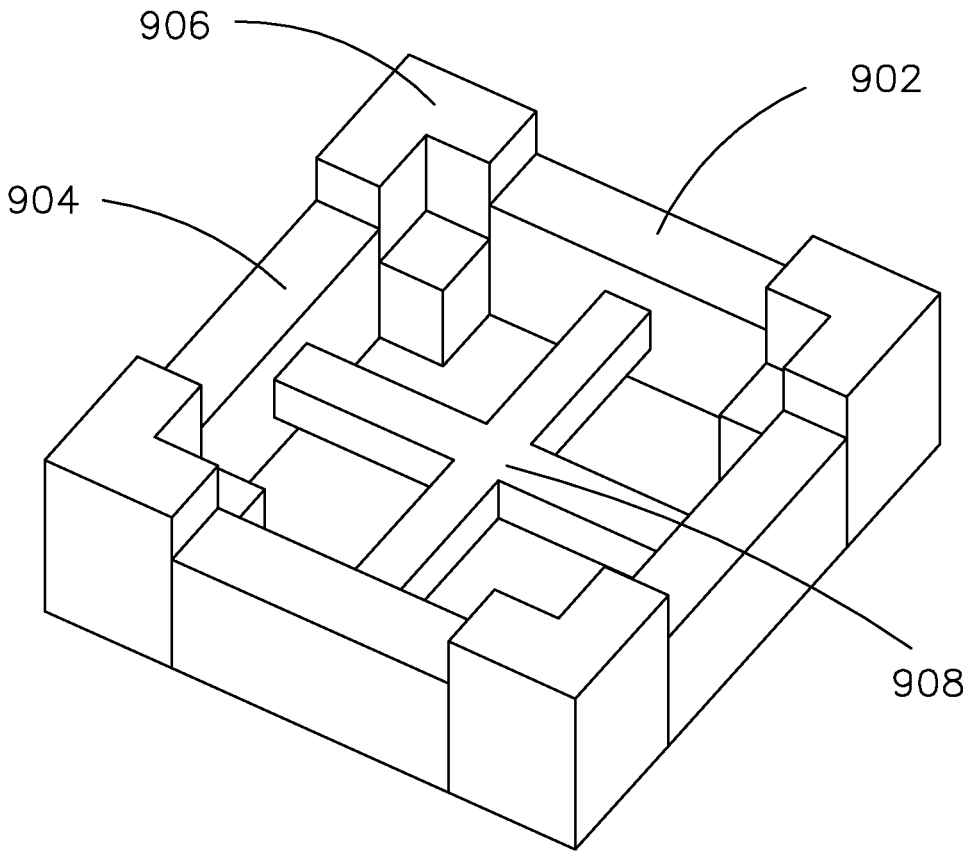
FIG. 2 is a schematic view showing the structure of a conventional package box.
Figure 3:
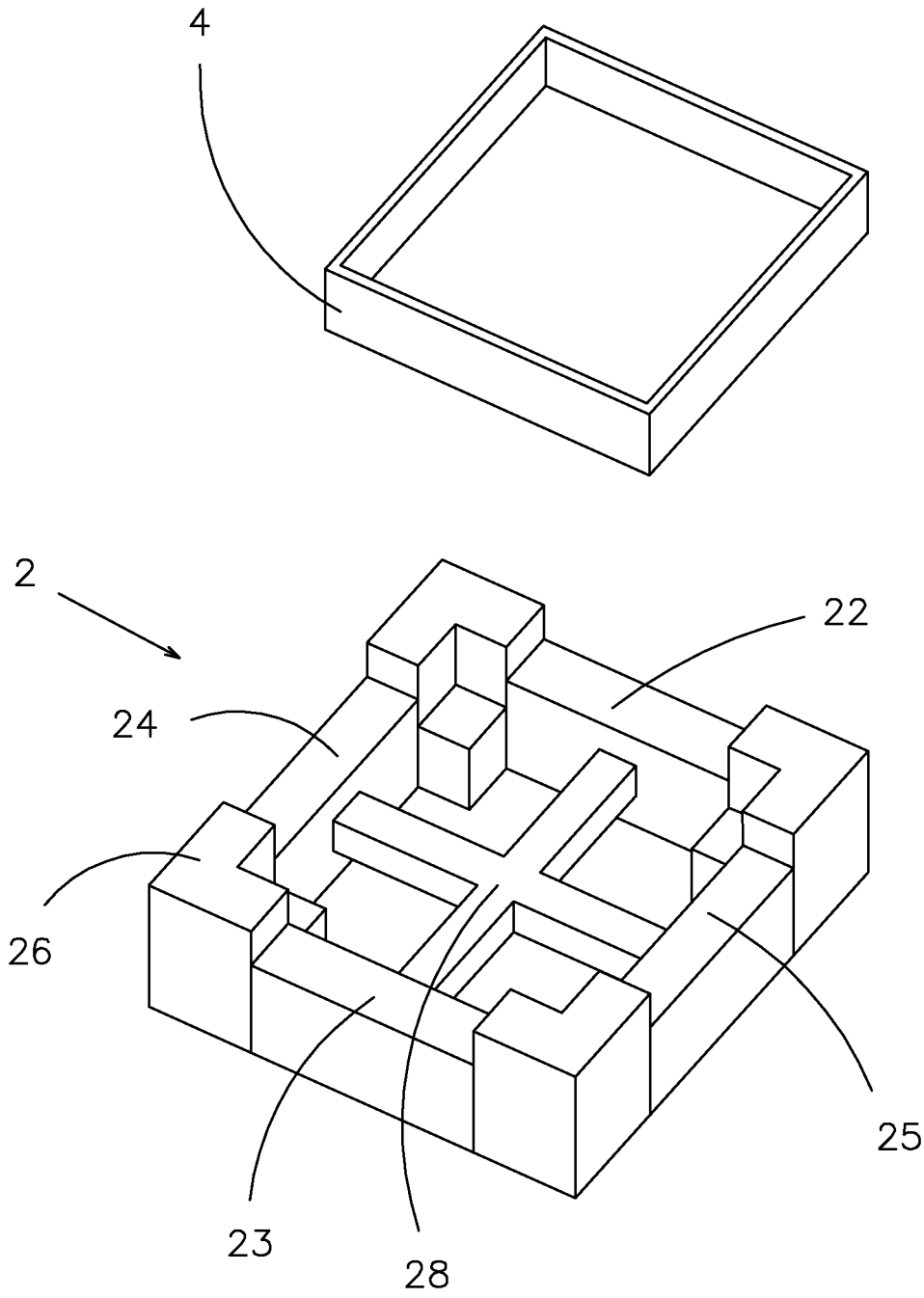
FIG. 3 is an exploded view showing a multi-size universal jointed package box according to the present invention.

To further expound the technical solution adopted in the present invention and the advantages thereof, a detailed description is given to a preferred embodiment of the present invention and the attached drawings.

Referring to FIGS. 3-6, the present invention provides a multi-size universal jointed package box, which comprises a box body 2 and waterproof pads 4 arranged inside the box body 2. A liquid crystal display panel (not shown) is received in the waterproof pads 4 to provide both humidity resistance and cushioning effect.

The box body 2 comprises first and second walls 22, 23 that are opposite to each other, third and fourth walls 24, 25 that are opposite to each other, four corner pieces 26 connecting between the first, second, third, and fourth walls 22, 23, 24, 25, and a cruciform support bracket 28 connected to a middle portion of each of the first, second, third, and fourth walls 22, 23, 24, 25. Couplings between the first, second, third, and fourth walls 22, 23, 24, 25 and the corner pieces 26 and those between the first, second, third, fourth walls 22, 23, 24, 25 and the support bracket 28 are all releasable couplings to allow the box body 2 to be formed through being jointed in a free style thereby making the size of the box body 2 adjustable to be fit to transportation of liquid crystal display panels of different sizes. Further, the support bracket 28 and the corner pieces 26 can be commonly used to thereby lower down the manufacturing cost.

Figure 4:
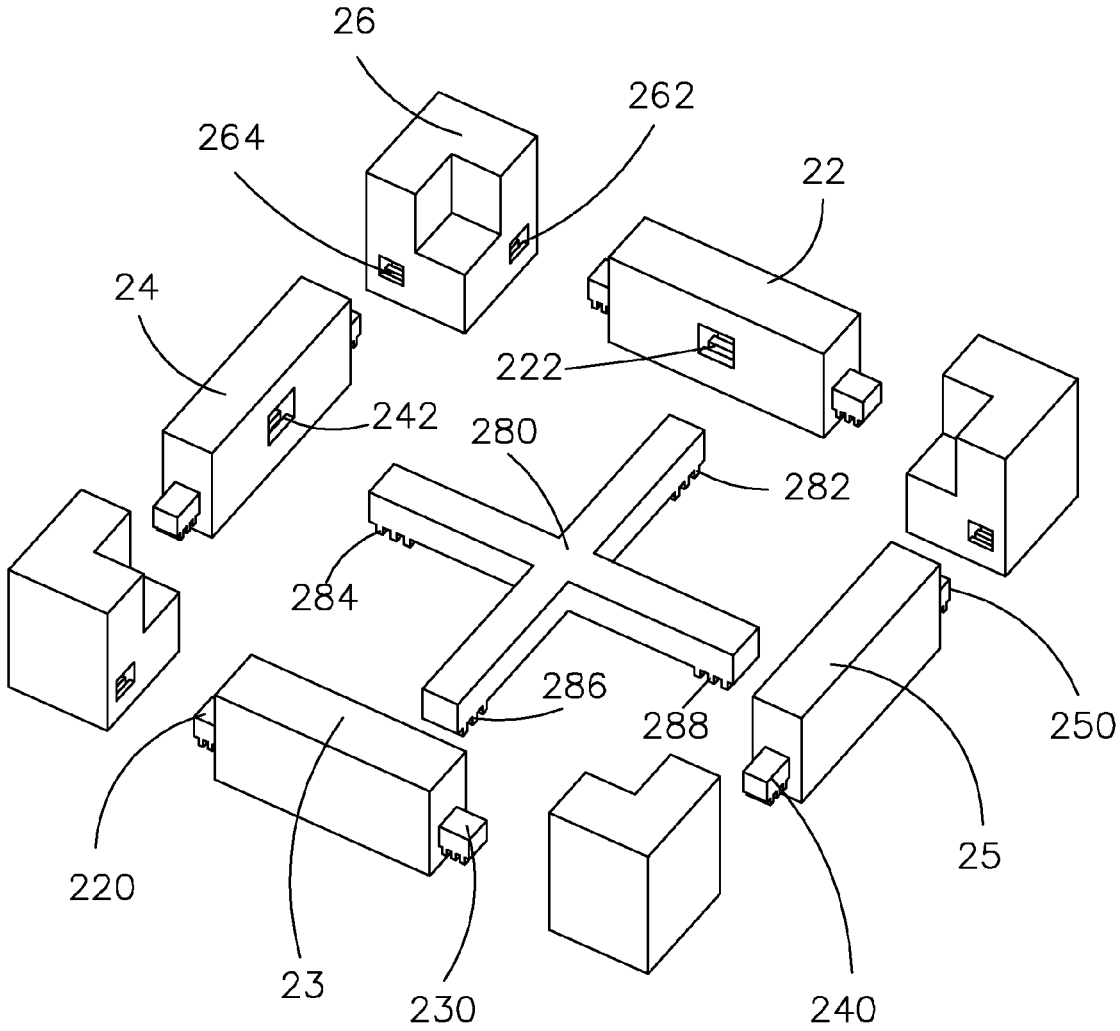
FIG. 4 is an exploded view showing a box body of a first embodiment of the multi-size universal jointed package box of the present invention.

Referring to FIG. 4, the support bracket 28 comprises a cruciform main body 280 and first, second, third, and fourth coupling members 282, 284, 286, 288 formed at four ends of the main body 280. The first and third coupling members 282, 286 are arranged opposite to each other. The second and fourth coupling members 284, 288 are arranged opposite to each other. The first, second, third, and fourth walls 22, 23, 24, 25 form first, second, third, and fourth coupling slots respectively corresponding to the first, second, third, and fourth coupling members 282, 284, 286, 288. The first, second, third, and fourth coupling members 282, 284, 286, 288 are respectively received in and coupled to the first coupling slot 222, the second coupling slot (not shown), the third coupling slot 242, and the fourth coupling slot (not shown) to couple the support bracket 28 to the first, second, third, and fourth walls 22, 23, 24, 25 in a releasable manner.

In the instant embodiment, the first, second, third, and fourth coupling members 282, 284, 286, 288 respectively comprise a plurality of resilient coupling keys formed at the four ends of the main body 280 of the support bracket 28. Preferably, the first, second, third, and fourth coupling members 282, 284, 286, 288 and the main body 280 are integrally formed together with an elastic material.

Figure 5:
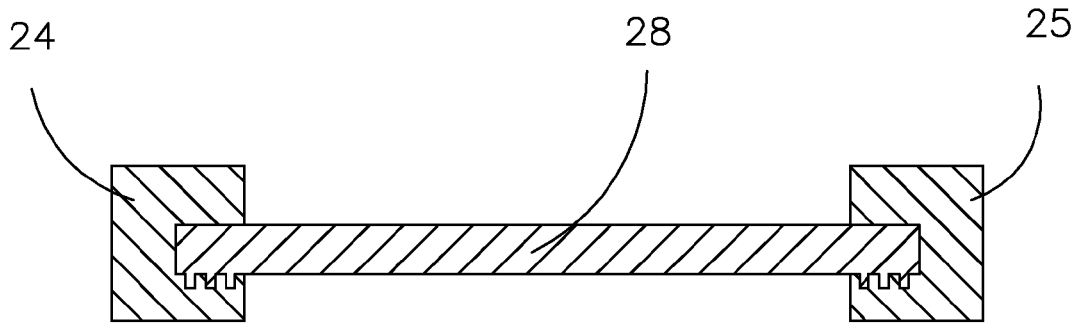
FIG. 5 is a cross-sectional view showing the box body of the first embodiment of the multi-size universal jointed package box of the present invention.
Figure 6:
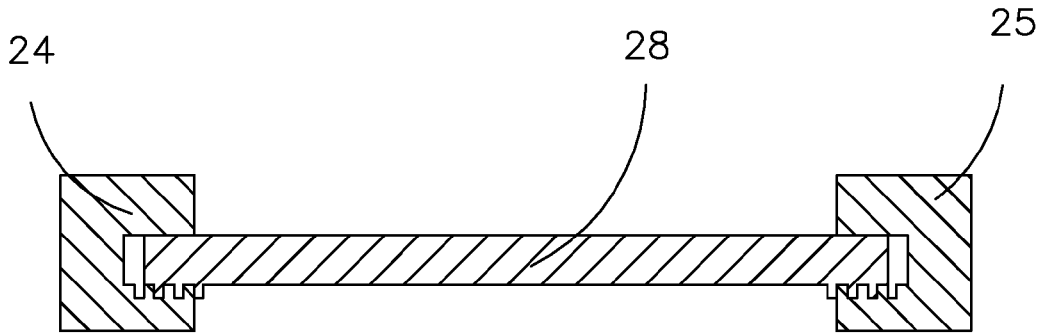
FIG. 6 is a cross-sectional view showing the box body of the first embodiment of the multi-size universal jointed package box of the present invention after size is adjusted.

To package a liquid crystal display panel having a relatively small size (as shown in FIG. 5), the first, second, third, and fourth coupling members 282, 284, 286, 288 formed at the four ends of the main body 280 of the support bracket 28 are respectively and completely received in the first coupling slot 222, the second coupling slot, the third coupling slot 242, and the fourth coupling slot. To package a liquid crystal display panel having a slightly large size (as shown in FIG. 6), the first, second, third, and fourth coupling members 282, 284, 286, 288 formed at the four ends of the main body 280 of the support bracket 28 are respectively and partially received in the first coupling slot 222, the second coupling slot, the third coupling slot 242, and the fourth coupling slot thereby increasing a receiving space of the box body 2 to properly accommodate a large-sized liquid crystal display panel.

The first and second walls 22, 23 each have two ends respectively forming first and second mounting sections 220, 230. The corner pieces 26 form first mounting slots 262 and second mounting slots (not shown) corresponding to the first mounting sections 220 and the second mounting sections 230. The third and fourth walls 24, 25 each have two ends respectively forming third and fourth mounting sections 240, 250. The corner pieces 26 form third mounting slots 264 and fourth mounting slots (not shown) corresponding to the third and fourth mounting sections 240, 250. The first, second, third, and fourth mounting sections 220, 230, 240, 250 are respectively received in and coupled to the first mounting slots 262, the second mounting slots, the third mounting slots 264, and the fourth mounting slots to couple the first, second, third, and fourth walls 22, 23, 24, 25 to the corner pieces 26 in a releasable manner.

The first and second walls 22, 23 have the same structure and size. The third and fourth walls 24, 25 have the same structure and size. Preferably, the first, second, third, and fourth mounting sections 220, 230, 240, 250 are of the same structure and size and the first mounting slots 262, the second mounting slots, the third mounting slots 264, and the fourth mounting slots are of the same structure and size to allow the corner pieces 26 to be fit to various walls thereby achieving universal use of the corner pieces 26 and effectively lowering down the manufacturing cost.

Figure 7:
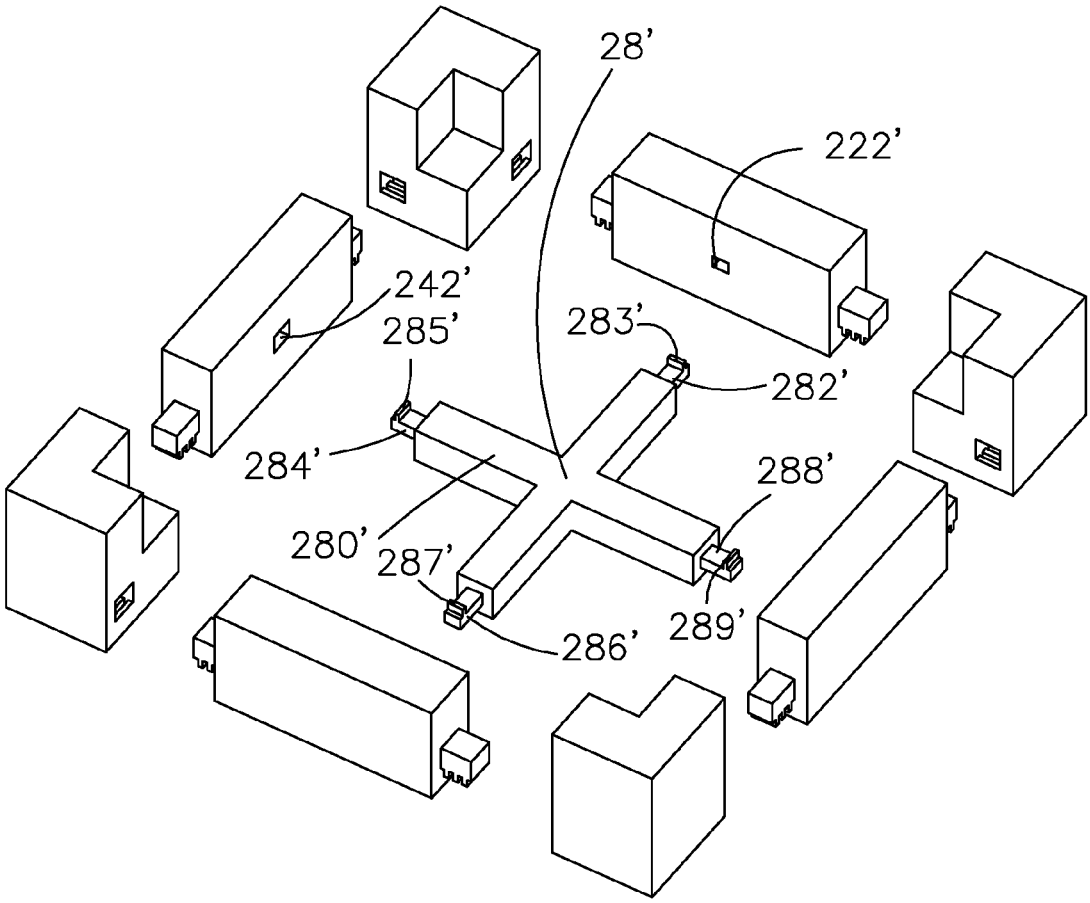
FIG. 7 is an exploded view showing a box body of a second embodiment of the multi-size universal jointed package box of the present invention.
Figure 8:
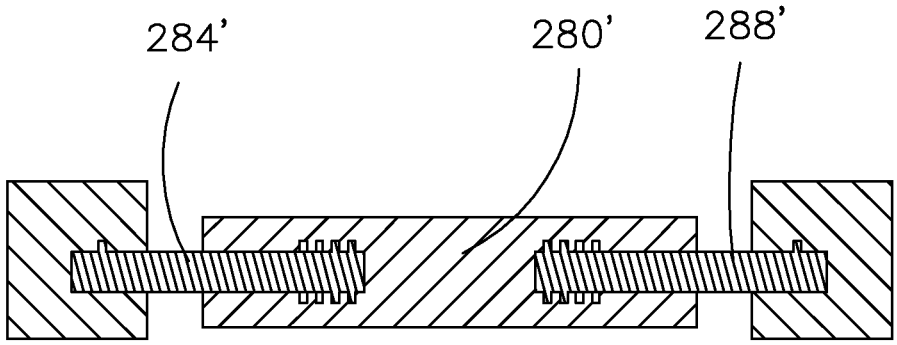
FIG. 8 is a cross-sectional view showing the box body of the second embodiment of the multi-size universal jointed package box of the present invention.
Figure 9:
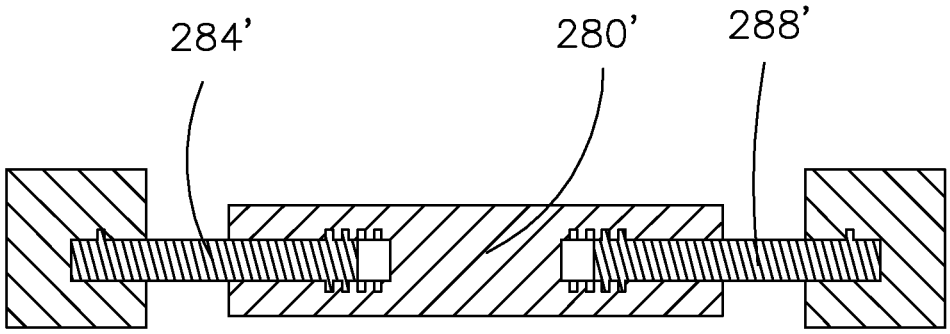
FIG. 9 is a cross-sectional view showing the box body of the second embodiment of the multi-size universal jointed package box of the present invention after size is adjusted.

Referring to FIGS. 7-9, an exploded view of a box body of a second embodiment of the multi-size universal jointed package box of the present invention is given. In the instant embodiment, first, second, third, and fourth coupling members 282', 284', 286', 288' are all of a linear form. The first coupling member 282' has an end forming a first coupling section 283' corresponding to the first coupling slot 222' and an opposite end forming a second coupling section (not shown) corresponding to the main body 280' of the support bracket 28'. The second coupling member 284' has an end forming a third coupling section 285' corresponding to the second coupling slot (not shown) and an opposite end forming a fourth coupling section corresponding to the main body 280' of the support bracket 28'. The third coupling member 286' has an end forming a fifth coupling section 287' corresponding to the third coupling slot 242' and an opposite end forming a sixth coupling section (not shown) corresponding to the main body 280' of the support bracket 28'. The fourth coupling member 288' has an end forming a seventh coupling section 289' corresponding to the fourth coupling slot (not shown) and an opposite end forming an eighth coupling section (not shown) corresponding to the main body 280' of the support bracket 28'.

The main body 280' of the support bracket 28' forms fifth, sixth, seventh, and eighth coupling slots (all not labeled) respectively corresponding to the second, fourth, sixth, and eighth coupling sections, whereby the second, fourth, sixth, and eighth coupling sections are respectively received in and coupled to the fifth, sixth, seventh, and eighth the coupling slots to couple the first, second, third, and fourth coupling members 282', 284', 286', 288' to the main body 280' of the support bracket 28' in a releasable manner.

To package a liquid crystal display panel having a relatively small size (as shown in FIG. 8), the second, fourth, sixth, and eighth coupling sections are respectively and completely received in the fifth, sixth, seventh, and eighth coupling slots. To package a liquid crystal display panel having a slightly large size (as shown in FIG. 9), the second, fourth, sixth, and eighth coupling section are respectively and partially received in the fifth, sixth, seventh, and eighth the coupling slots.

In the instant embodiment, the first and third coupling members 282', 286' are of the same structure and size. The second and fourth coupling members 284', 288' are of the same structure and size. Preferably, the first, second, third, and fourth coupling members 282', 284', 286', 288' are all of the same structure and size so that the first, second, third, and fourth coupling members 282', 284', 286', 288' can be manufactured with a single mold to thereby lower downing the cost of making mold.

In summary, the present invention provides a multi-size universal jointed package box, which comprises a support bracket having four ends each forming resilient coupling keys and first, second, third, and fourth walls each forming a coupling slot to realize free style jointing for forming a package box, whereby the package box has a size that is adjustable to be fit to the transportation of liquid crystal display panels of various sizes. Further, the support bracket and corner pieces are commonly usable to thereby effectively lower down the manufacturing cost.

Based on the description given above, those having ordinary skills of the art may easily contemplate various changes and modifications of the technical solution and technical ideas of the present invention and all these changes and modifications are considered within the protection scope of right for the present invention.

What is claimed is:

1. A multi-size universal jointed package box, comprising a box body and waterproof pads arranged inside the box body, the box body comprising first and second walls that are opposite to each other, third and fourth walls that are opposite to each other, four corner pieces connecting between the first, second, third, and fourth walls, and a cruciform support bracket connected to a middle portion of each of the first, second, third, and fourth walls, whereby couplings between the first, second, third, and fourth walls and the corner pieces and couplings between the first, second, third, fourth walls and the support bracket are all releasable couplings;

wherein the support bracket comprises a cruciform main body and first, second, third, and fourth coupling members formed at four ends of the main body, the first and third coupling members being arranged opposite to each other, the second and fourth coupling members being arranged opposite to each other, the first, second, third, and fourth walls forming first, second, third, and fourth coupling slots respectively corresponding to the first, second, third, and fourth coupling members, the first, second, third, and fourth coupling members being respectively received in and coupled to the first, second, third, and fourth coupling slots to couple the support bracket to the first, second, third, and fourth walls in a releasable manner; and wherein the first, second, third, and fourth coupling members respectively comprise a plurality of resilient coupling keys formed at the four ends of the main body of the support bracket.

2. The multi-size universal jointed package box as claimed in claim 1, wherein the first, second, third, and fourth coupling members and the main body are integrally formed together.

3. A multi-size universal jointed package box, comprising a box body and waterproof pads arranged inside the box body, the box body comprising first and second walls that are opposite to each other, third and fourth walls that are opposite to each other four corner pieces connecting between the first, second, third, and fourth walls and a cruciform support bracket connected to a middle portion of each of the first, second, third and fourth walls whereby couplings between the first, second, third, and fourth walls and the corner pieces and couplings between the first, second, third, fourth walls and the support bracket are all releasable couplings;

wherein the support bracket comprises a cruciform main body and first, second, third, and fourth coupling members formed at four ends of the main body, the first and third coupling members being arranged opposite to each other, the second and fourth coupling members being arranged opposite to each other the first, second, third, and fourth walls forming first, second, third, and fourth coupling slots respectively corresponding first, second, third, and fourth coupling members the first, second, third, and fourth coupling members being respectively received in and coupled to the first, second, third, and fourth coupling slots to couple the support bracket to the first, second, third, and fourth walls in a releasable manner; and wherein the first, second, third, and fourth coupling members are all of a linear form, the first coupling member having an end forming a first coupling section corresponding to the first coupling slot and an opposite end forming a second coupling section corresponding to the main body of the support bracket, the second coupling member having an end forming a third coupling section corresponding to the second coupling slot and an opposite end forming a fourth coupling section corresponding to the main body of the support bracket, the third coupling member having an end forming a fifth coupling section corresponding to the third coupling slot and an opposite end forming a sixth coupling section corresponding to the main body of the support bracket, the fourth coupling member having an end forming a seventh coupling section corresponding to the fourth coupling slot and an opposite end forming an eighth coupling section corresponding to the main body of the support bracket.

4. The multi-size universal jointed package box as claimed in claim 3, wherein the main body of the support bracket forms fifth, sixth, seventh, and eighth coupling slots respectively corresponding to the second, fourth, sixth, and eighth coupling sections, whereby the second, fourth, sixth, and eighth coupling sections are respectively received in and coupled to the fifth, sixth, seventh, and eighth coupling slots to couple the first, second, third, and fourth coupling members to the main body of the support bracket in a releasable manner.

5. The multi-size universal jointed package box as claimed in claim 1, wherein the first and third coupling members are of same structure and size and the second and fourth coupling members are of same structure and size.

6. A multi-size universal jointed package box, comprising a box body and waterproof pads arranged inside the box body, the box body comprising first and second walls that are opposite to each other, third and fourth walls that are opposite to each other four corner pieces connecting between the first, second, third, and fourth walls and a cruciform support bracket connected to a middle portion of each of the first, second, third and fourth walls, whereby couplings between the first, second, third, and fourth walls and the corner pieces and couplings between the first, second, third, fourth walls and the support bracket are all releasable couplings;

wherein the first and second walls each have two ends respectively forming first and second mounting sections, the corner pieces forming first and second mounting slots corresponding to the first and second mounting sections, the third and fourth walls each having two ends respectively forming third and fourth mounting sections, the corner pieces forming third and fourth mounting slots corresponding to the third and fourth mounting sections, the first, second, third, and fourth mounting sections being respectively received in and coupled to the first, second, third, and fourth mounting slots to couple the first, second, third, and fourth walls to the corner pieces in a releasable manner.

7. The multi-size universal jointed package box as claimed in claim 6, wherein the first and second walls are of the same structure and size and the third and fourth walls are of the same structure and size.

8. The multi-size universal jointed package box as claimed in claim 7, wherein the first, second, third, and fourth mounting sections are of the same structure and size and the first, second, third, and fourth the mounting slots are of the same structure and size.

9. A multi-size universal jointed package box, comprising a box body and waterproof pads arranged inside the box body, the box body comprising first and second walls that are opposite to each other, third and fourth walls that are opposite to each other, four corner pieces connecting between the first, second, third, and fourth walls, and a cruciform support bracket connected to a middle portion of each of the first, second, third, and fourth walls, whereby couplings between the first, second, third, and fourth walls and the corner pieces and couplings between the first, second, third, fourth walls and the support bracket are all releasable couplings;

wherein the support bracket comprises a cruciform main body and first, second, third, and fourth coupling members formed at four ends of the main body, the first and third coupling members being arranged opposite to each other, the second and fourth coupling members being arranged opposite to each other, the first, second, third, and fourth walls forming first, second, third, and fourth coupling slots respectively corresponding to the first, second, third, and fourth coupling members, the first, second, third, and fourth coupling members being respectively received in and coupled to the first, second, third, and fourth coupling slots to couple the support bracket to the first, second, third, and fourth walls in a releasable manner;

wherein the first, second, third, and fourth coupling members respectively comprise a plurality of resilient coupling keys formed at the four ends of the main body of the support bracket;

wherein the first, second, third, and fourth coupling members and the main body are integrally formed together;

wherein the first and second walls each have two ends respectively forming first and second mounting sections, the corner pieces forming first and second mounting slots corresponding to the first and second mounting sections, the third and fourth walls each having two ends respectively forming third and fourth mounting sections, the corner pieces forming third and fourth mounting slots corresponding to the third and fourth mounting sections, the first, second, third, and fourth mounting sections being respectively received in and coupled to the first, second, third, and fourth mounting slots to couple the first, second, third, and fourth walls to the corner pieces in a releasable manner;

wherein the first and second walls are of the same structure and size and the third and fourth walls are of the same structure and size; and wherein the first, second, third, and fourth mounting sections are of the same structure and size and the first, second, third, and fourth the mounting slots are of the same structure and size.

* * * * *